US005232377A

United States Patent [19]

Leibfried, Jr.

[11] Patent Number: 5,232,377

[45] Date of Patent: Aug. 3, 1993

[54] COAXIAL CONNECTOR FOR SOLDERING TO SEMIRIGID CABLE

[75] Inventor: Richard G. Leibfried, Jr., Mechanicsburg, Pa.

[73] Assignee: AMP Incorporated, Harrisburg, Pa.

[21] Appl. No.: 841,664

[22] Filed: Mar. 3, 1992

[51] Int. Cl.[5] ..... H01R 4/38

[52] U.S. Cl. ..... 439/320; 439/578

[58] Field of Search ..... 439/310, 320, 321, 322, 439/578, 583, 584, 585

[56] References Cited

U.S. PATENT DOCUMENTS

| | | | |
|---|---|---|---|
| 3,676,573 | 7/1972 | Avery | 439/320 |
| 3,764,959 | 10/1973 | Toma et al. | 439/584 |
| 3,778,535 | 12/1973 | Forney, Jr. | 174/88 C |
| 3,824,686 | 7/1974 | Forney, Jr. | 29/628 |
| 4,256,945 | 3/1981 | Carter et al. | 219/10.75 |
| 4,408,821 | 10/1983 | Forney, Jr. | 339/177 R |
| 4,447,107 | 5/1984 | Major, Jr. | 339/171 E |
| 4,452,503 | 6/1984 | Forney, Jr. | 339/177 R |
| 4,540,231 | 9/1985 | Forney, Jr. | 339/94 C |
| 4,557,546 | 12/1985 | Dreyer | 339/177 R |
| 4,583,811 | 4/1986 | McMills | 339/177 R |
| 4,596,434 | 6/1986 | Saba et al. | 439/578 |
| 4,626,767 | 12/1986 | Clappier et al. | 323/280 |
| 4,659,912 | 4/1987 | Derbyshire | 219/535 |
| 4,688,877 | 8/1987 | Dreyer | 439/584 |
| 4,789,767 | 12/1988 | Doljack | 219/9.5 |
| 4,834,676 | 5/1989 | Tackett | 439/584 |
| 4,852,252 | 8/1989 | Ayer | 29/860 |
| 5,002,503 | 3/1991 | Campbell et al. | 439/578 |
| 5,052,946 | 10/1991 | Homolka | 439/584 |

OTHER PUBLICATIONS

AMP Catalog 80-570, "Guide to RF Connectors", pp. 93, 95; May 1990; AMP Incorporated, Harrisburg, Pa.

*Primary Examiner*—Larry I. Schwartz
*Assistant Examiner*—Hien D. Vu
*Attorney, Agent, or Firm*—Anton P. Ness

[57] ABSTRACT

A retention sleeve (150) is placed over the rearward end (134) of the outer conductive shell (120) of a coaxial plug connector (100), providing a rearward stop for retaining the coupling nut (12) on the shell. The retention sleeve can include an inwardly directed flange (158) at its rearward end for retention of an annular solder preform (132) within the cable-receiving bore (136) of the outer conductive shell. The retention sleeve (150) can be of low resistance copper having a thin outer layer (170) of magnetic high resistance metal, defining a self-regulating temperature source when subjected to RF current, to reflow the solder of the preform (132) and thus solder the outer conductive shell (120) to the semirigid outer conductor (82) of the coaxial cable end inserted into the cable-receiving bore (136) providing for automated soldering.

6 Claims, 3 Drawing Sheets

COAXIAL CONNECTOR FOR SOLDERING TO SEMIRIGID CABLE

FIELD OF THE INVENTION

This relates to electrical connectors and more particularly to coaxial connectors for semirigid coaxial cable.

BACKGROUND OF THE INVENTION

Certain connectors for coaxial cable which are commercially available, include a coupling nut assembled to the outer conductive shell which threadedly couples with the outer conductive shell of a mating connector to bring together and retain the connectors in an assuredly mated condition to interconnect a coaxial cable to another like cable or to an electrical apparatus or the like. The connector includes an inner contact or inner conductor within a dielectric sleeve all within the outer conductive shell. The inner contact is electrically engageable with a contact terminated onto the signal conductor of the coaxial cable, which is disposed within an insulative jacket, all within an outer cable conductor. Certain coaxial cable has a semirigid outer conductor such as of copper alloy, and the outer conductive shell of the connector is commonly soldered to the semirigid conductor; the center conductor of the cable includes an end section extending forwardly from the cable end and is commonly received into and mated with a rearward socket section of the inner contact of the connector. The coupling nut is secured to the outer conductive shell in a manner permitting rotation thereabout but is stopped from axial movement therealong; the coupling nut is rotated about the first connector to become fully threaded to the mating connector, incrementally drawing the mating connector toward the first connector and its mating face firmly against the mating face of the first connector for the complementary inner and outer conductors to become electrically connected.

One particular such coaxial connector is sold by AMP Incorporated, Harrisburg, PA under the designation SMA Plug Connector and having Part No. 413071-1, matable with an SMA Bulkhead Jack such as Part No. 228642-2. In this connector assembly, the coupling nut is secured about the front section of the outer conductor and includes an inwardly directed flange at its rearward end which defines a forwardly facing surface opposing a rearwardly facing stop surface of a collar of the outer conductor to establish a forward stop. A crescent clip or C-clip is secured to the outer conductor, seated within an annular groove into the central section just rearwardly of the rearward end of the coupling nut, to define a forwardly facing surface opposing the rearward surface of the coupling nut to establish a rearward stop. An inwardly directed annular flange of the outer conductor provides a seat for the apertured rearward end of the dielectric sleeve containing the inner contact, and the rearward socket section of the inner contact is recessed within the apertured rearward end of the dielectric sleeve and just forwardly of the inwardly directed flange. The rearward section of the outer conductor includes a large bore adapted to receive inserted thereinto an end of the semirigid outer conductor of the cable, for soldering which is commonly performed manually.

It is desired to provide a simpler assembly procedure for a coaxial connector having a coupling nut retained thereon, for termination of semirigid coaxial cable.

It is also desired to simplify the soldering procedure for termination of the semirigid outer conductor of the cable to the outer conductive shell of the connector.

SUMMARY OF THE INVENTION

The present invention provides a retention sleeve for placement on the conductive shell or outer conductor of a coaxial connector and having a forward end which defines the rearward stop for coupling nut retention. The retention sleeve includes an inner diameter which is incrementally smaller than the outer diameter of the rearward section of the outer conductive shell to establish an interference fit with at least a portion of the rearward section. The retention sleeve further includes an inwardly directed annular flange at the rearward end thereof which abuts the end of the rearward shell section for controllably locating the fully assembled position of the retention sleeve on the outer conductive shell.

The bore of the rearward section of the outer conductive shell includes a larger diameter rearward bore portion providing a seat for placement of an annular solder preform or ring thereinto prior to placement of the retention sleeve onto the outer conductive shell. Preferably the periphery of the aperture through the inwardly directed annular flange of the rearward end of the retention sleeve is chamfered to form a lead-in to facilitate insertion therethrough of the end of the semirigid coaxial cable.

The retention sleeve is composed of low resistance non-magnetic metal; the outwardly facing surface of the retention sleeve includes a thin layer of high resistance magnetic material integrally joined thereonto. So fabricated, the retention sleeve defines a Curie point heater of the type disclosed in U.S. Pat. No. 4,852,252.

For cable termination, the connector assembly containing the solder preform therewithin receives the end of the semirigid cable into the rearward section thereof, which electrically engages the inner contact with the signal contact of the cable, and is then subjected to high frequency alternating current such as radiofrequency current (RF) of 13.56 megaHertz for several seconds. The self-regulating temperature heater defined by the retention sleeve generates thermal energy until a Curie point temperature is achieved such as about 240° C., a certain amount higher than the reflow temperature such as about 183° C. The thermal energy reflows the solder of the preform which flows along the surface of the semirigid cable and the inwardly directed annular flange of the retention sleeve to form a solder joint between the cable's outer conductor and the retention sleeve which is assuredly electrically joined to the outer conductive shell of the connector by the interference fit.

It is an objective of the present invention to provide a sleeve adapted to be easily applied onto and self retaining on the rearward section of the outer conductive shell of a commercially accepted coaxial connector having proven impedance performance, to provide retention of the existing coupling nut on the outer conductive shell.

It is a further objective for such retention sleeve to provide for automated soldering of the semirigid cable outer conductor to the outer conductive shell of the connector.

It is also an objective for the soldering provided for by the retention sleeve to be controlled by an inherent maximum temperature high enough only to reflow the solder and also limited duration of application of thermal energy, thus protecting the cable insulation and the dielectric sleeve of the connector from degradation.

An embodiment of the present invention will now be described by way of example with reference to the accompanying drawings.

DETAILED DESCRIPTION OF THE PREFERRED EMBODIMENT

Figure 1:
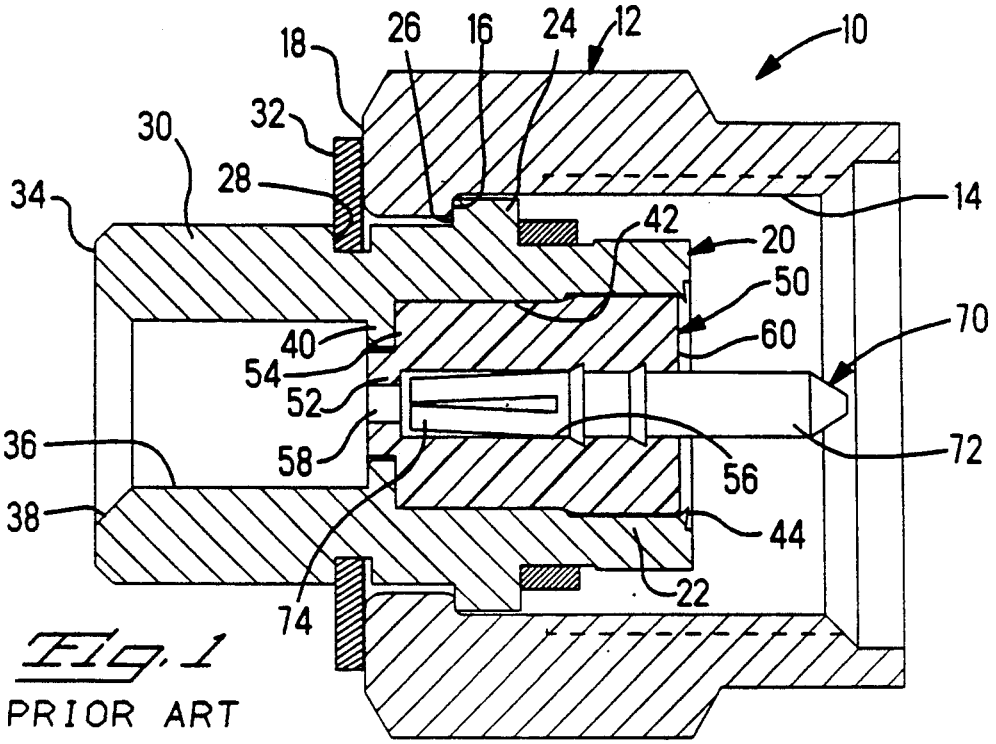
Fig. 1 PRIOR ART
FIG. 1 is a longitudinal section view of a coaxial connector of the prior art, having a C-clip secured about the outer conductor rearwardly of the coupling nut.
Figure 3:
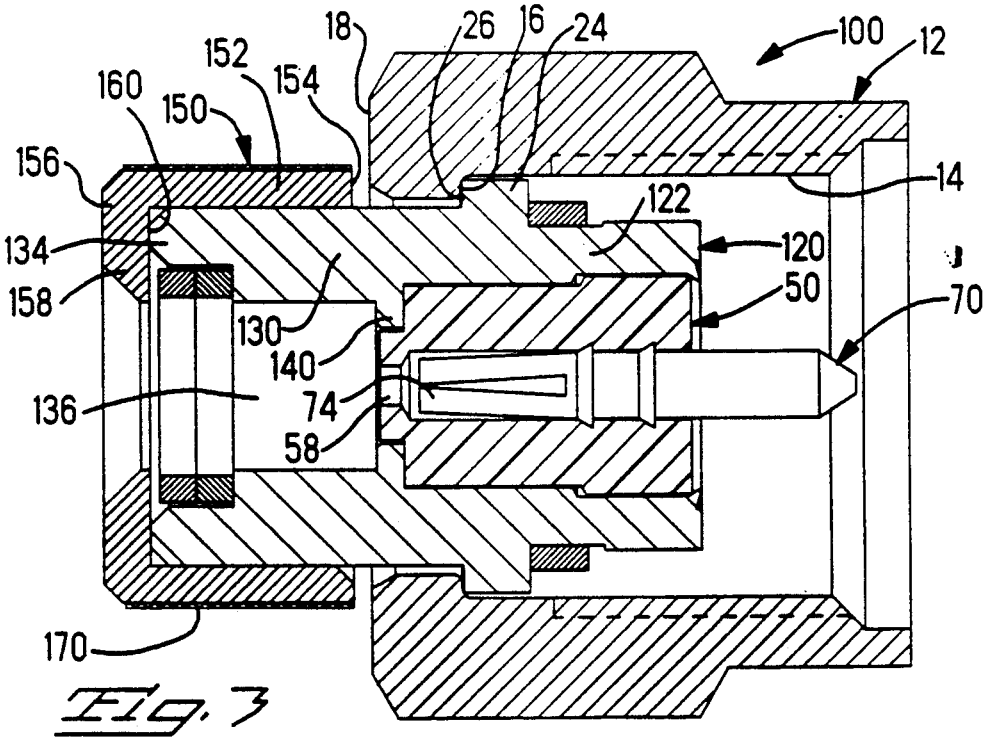
FIGS. 2 to 4 are section views of the present invention being assembled, fully assembled including solder preform, and receiving an end of the coaxial cable thereinto, respectively.

A PRIOR ART coaxial connector 10 is illustrated in FIG. 1, in which the coupling nut 12 is secured onto the forward section 22 of the conductive shell or outer conductor 20 and includes a threaded forward portion 14 for threadedly receiving a correspondingly threaded outer surface of the conductive shell or outer conductor of a mating connector (not shown). Coupling nut 12 includes an inwardly directed flange 16 at rearward nut end 18 which has an inner diameter less than the outer diameter of a collar 24 of outer conductor 20, so that rearwardly facing surface 26 of collar 24 defines a forward stop for coupling nut 12. An annular groove 28 is provided circumferentially around outer conductor 20 about midway therealong between forward section 22 and rearward section 30; secured within annular groove 28 just rearwardly of rearward end 18 of coupling nut 12 is a crescent ring or C-clip 32 which establishes a rearward stop for retention of coupling nut 12 on outer conductor 20. Extending into rearward end 34 of rearward section 30 is a cable-receiving bore 36 having a chamfered entrance 38 into which an end portion of a semirigid cable is inserted until seated against inwardly directed flange 40 which is positioned just forwardly of annular groove 28.

A dielectric sleeve 50 is secured within forward section 22 of outer conductor 20, having a reduced diameter axial flange 52 extending rearwardly from rearward face 54 and which extends through inwardly directed flange 40 to cable-receiving bore 36. Profiled centered passageway 56 extends from a small diameter portion 58 through axial flange 52 forwardly to forward sleeve end 60 and an inner contact 70 is secured therewithin. Inner contact 70 includes a front pin section 72 extending forwardly of dielectric sleeve 50 and within threaded portion 14 of coupling nut 12 to mate with a complementary contact section of a mating connector (not shown); a socket contact section 74 is defined at the rearward end of inner contact 70 and is disposed within profiled passageway 56 aligned with small diameter passageway portion 58 to receive and mate with an end section of the inner conductor of a coaxial cable (see FIG. 4).

Dielectric sleeve 50 is secured within outer conductor 20 by being force fit into forward cavity 42 of forward section 22 and is seated against inwardly directed annular flange 40 of outer conductor 20, after which the leading end of the outer conductor is slightly staked at 44 over the periphery of forward end 60 of dielectric sleeve 50. When dielectric sleeve 50 with inner contact 70 secured therein is assembled within outer conductor 20, inner contact 70 is held precisely centered within the outer conductor, which has a precisely selected inside diameter in cooperation with a precisely selected outer diameter of dielectric sleeve 50 for optimum impedance performance.

Figure 2:
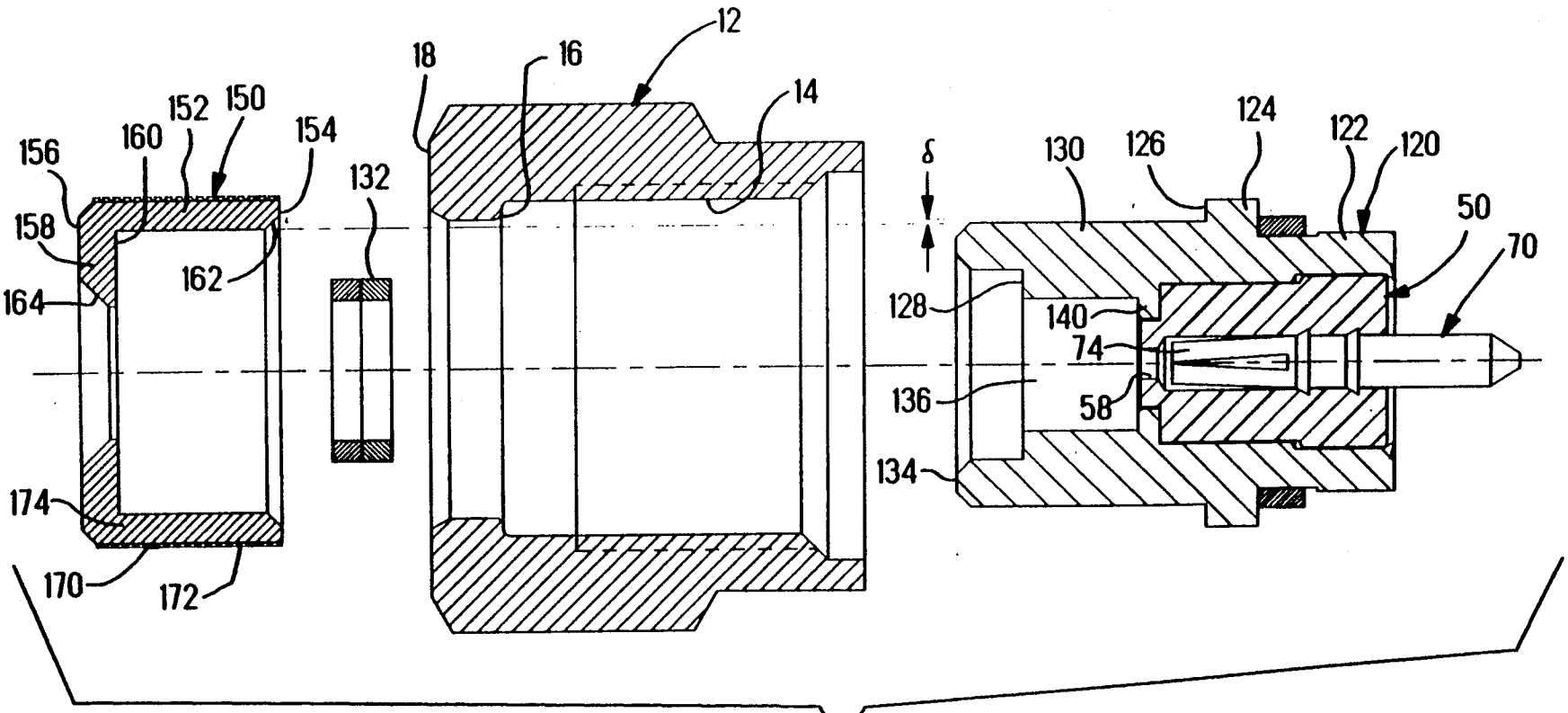

The present invention includes a retention sleeve 150 which is placed onto rearward section 130 of outer conductive shell 120 with a body section 152 extending from leading end 154 to rearward end 156. An inwardly directed annular flange 158 is fabricated at rearward end 156 and defines a forwardly facing surface 160. Body section 152 has an inner diameter just less than the outer diameter of rearward section 130 of outer conductive shell 120 and an axial length less than that of rearward section 130, so that when retention sleeve is pushed onto rearward section 130 from rearward end 134, an interference fit is defined to retain retention sleeve 150 thereon with leading end 154 slightly spaced from end 18 of coupling nut 12, located to provide a rearward stop for coupling nut 12. Preferably leading end 154 includes a chamfered inner peripheral surface 162 (FIG. 2) to facilitate being received rearward end 134 of outer conductive shell 120. Also preferably rearward end 156 is chamfered at 164 to form a lead-in for receipt of an end of semi-rigid cable. The inner diameter of body section 152 of retention sleeve 150 may be selected to be about 0.002 inches less than the outer diameter of rearward section 130 of outer conductive shell 120, so that the difference $\delta$ is about 0.001 inches. Retention sleeve 150 may be made by being machined from tubular stock of beryllium copper or brass or nonmagnetic stainless steel, and gold plated over nickel underplating if desired.

A further aspect of the present invention is provided by a layer of metal 170 on the outer surface 172 of body section 152 of retention sleeve 150 which constitutes a first layer. Outer or second layer 170 can be intimately joined to outer surface 172 such as by cladding. Second layer 170 is formed from metal having high resistance and high magnetic permeability such as Alloy 42 having 42 percent nickel, 58 percent iron, for example, and of a thickness comprising at least one skin depth for such metal, such as about 0.0015 inches or between 0.0010 to 0.0020 inches. First layer 152 is of a metal of low resistance and minimal magnetic permeability, such as beryllium copper. The bimetallic structure so formed comprises a Curie point self-regulating temperature source achieving a temperature sufficient to reflow the solder when subjected to radiofrequency current, in a manner as is generally disclosed in U. S. Pat. Nos. 4,256,945 and 4,659,912. One example of solder material is Sn 63 tin-lead having a reflow temperature of 183° C.

Figure 4:
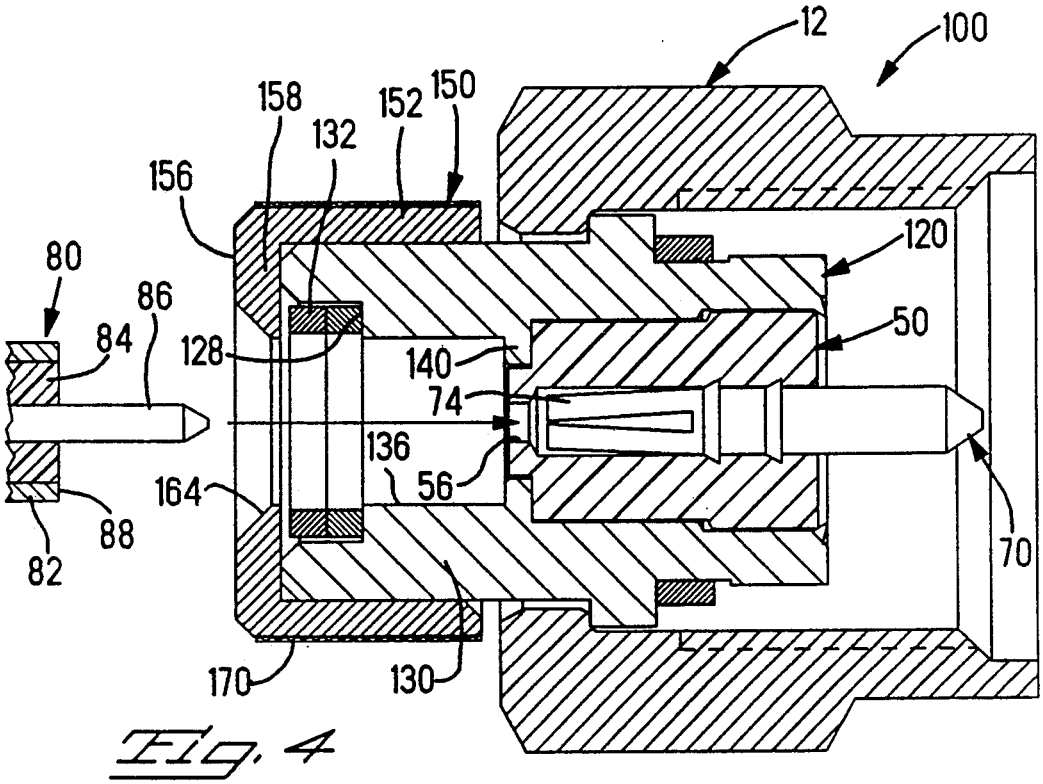

In FIG. 4 an end portion of semirigid coaxial cable 80 is shown to include a semirigid outer conductor 82, insulative jacket 84 and inner conductor 86 having an end portion extending forwardly from end face 88 of the cable.

Figure 5:
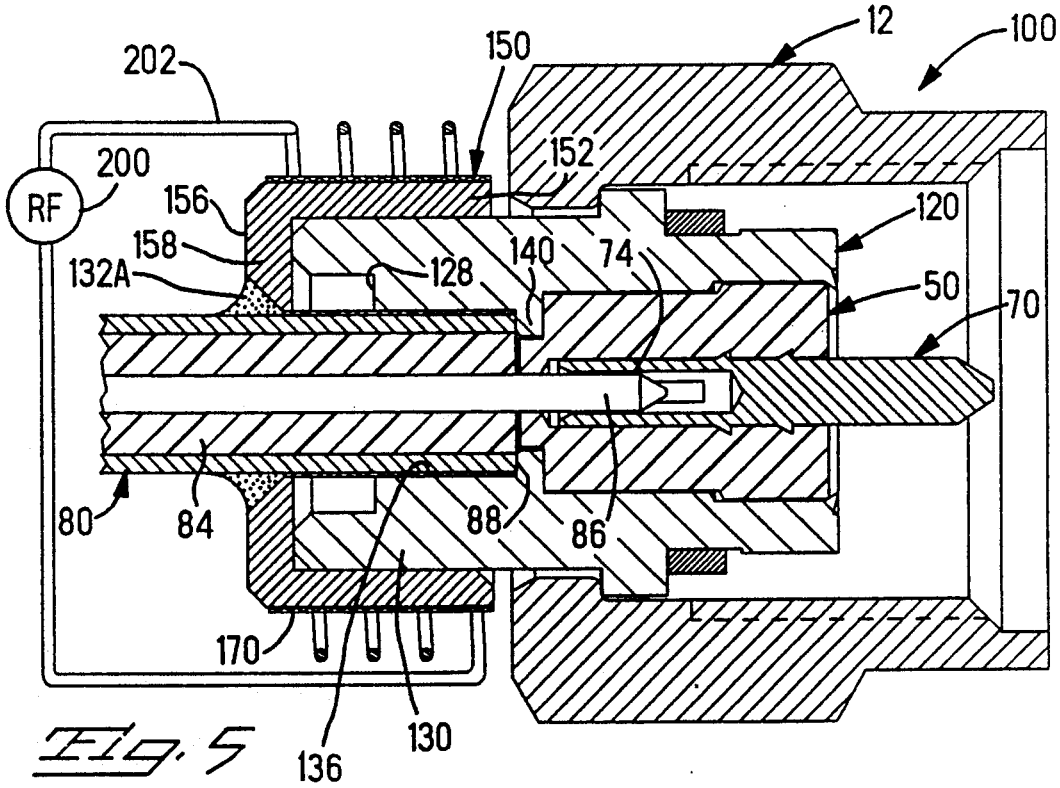
FIG. 5 is a section view of the connector soldered to the outer cable conductor by induction of RF current in the retention sleeve having reflowed the solder.

In FIG. 5 the end portion of cable 80 has been inserted into cable-receiving bore 136 of outer conductive shell 120 until front end 88 abuts inwardly directed flange 140, with terminal 86 comprising the cable's inner conductor is received through smaller diameter portion 58 of dielectric sleeve 50 and becomes electrically mated with socket contact section 74 of inner contact 70 of connector 100. Rearward section 130 of connector 100 with retention sleeve 150 thereon and containing the end portion of cable 80 inserted thereinto is placed within a coil 202 of a generator 200 of radiofrequency current such as are disclosed in U. S. Pat. Nos. 4,626,767 and 4,789,767, which can produce an RF current of about 13.56 megaHertz. The generator is then activated for a length of time such as about 5 seconds which activates the integral Curie point heater defined by the bimetallic structure of retention sleeve 150 to generate thermal energy until the Curie temperature is achieved, above which the Curie point heater will not rise, such as 240° C. A temperature is achieved at outer conductor 82 of cable 80 adjacent solder preform 132 (183° C.) sufficient to reflow the solder which wets along semirigid conductor 82 and forms a solder joint between the inner surface of cable-receiving bore 136 of outer conductor 82 and outer conductive shell 120 of connector 100 and also inwardly directed annular flange 158 of retention sleeve 150 forming an assured mechanical joint between the cable and the connector. If desired, solder resist material such as inert polyamide resin could be disposed along surfaces of annular recess 128 and rearward end 134 of outer conductive shell 120, and the forwardly facing surface of inwardly directed flange 158 of retention sleeve 150 assuring that all solder remains where desired when reflowed.

Variations and modifications to the specific embodiment disclosed herein which are within the spirit of the invention and the scope of the claims.

The above mentioned connectors of the present invention can also be soldered by conventional methods such as a soldering iron if the RF supply normally used is unavailable.

I claim:

1. An improved coaxial connection of the type having a coupling nut secured about an outer conductive shell and freely rotatable thereabout for threaded coupling to a complementary coaxial connector to secure the connector together to define an electrical coaxial connection therebetween at respective forward ends thereof, applicable to an end of a coaxial cable having a semirigid outer conductor, the improvement comprising:

a retention sleeve insertable over a rearward section of said outer conductive shell from a rearward end thereof, said retention sleeve having a leading and having an outer diameter greater than an inner diameter at a rear face of said coupling nut and thereby defining a rearward stop for said coupling nut for retention of said coupling nut about said outer conductive shell, and said retention sleeve having a rearward end associated with said outer conductive shell rearward end upon assembly, said retention sleeve having a body section having an inner diameter incrementally smaller than an outer diameter of said rearward section of said outer conductive shell, and said retention sleeve including an inwardly directed annular flange at said rearward end thereof and defining a transverse surface abuttingly engageable with a corresponding transverse portion of said rearward end of said outer conductive shell, whereby upon final assembly when said retention sleeve is moved forwardly over said outer conductive shell from said rearward end, said inwardly directed annular flange abuts said rearward end of said outer conductive shell stopping forward movement of paid retention sleeve for said leading end to face and be spaced from said rear face of said coupling nut.

2. An improved coaxial connector as set forth in claim 1 wherein said inwardly directed annular flange has an inner diameter just larger than the outer diameter of said semirigid cable outer conductor and includes a chamfered entrance aligned with a cable-receiving bore of said rearward section of said outer conductive shell, whereby a coaxial connector is defined adapted for receipt of an end of said semirigid cable outer conductor thereinto during termination of said connector to said cable.

3. An improved coaxial connector as set forth in claim 2 wherein said rearward section of said outer conductive shell includes an annular recess into said rearward end thereof, and an annular preform of solder is disposed in said annular recess inwardly of said inwardly directed annular flange of said retention sleeve to be reflowed to solder said outer conductive shell to said semirigid outer conductor of said cable.

4. An improved coaxial connector of the type having an outer conductive shell in which is contained a dielectric sleeve containing an inner contact, and having a rearward end adapted to be terminated to an end of a coaxial cable having a semirigid outer conductor around an insulative jacket containing an inner conductor having an end thereof extending beyond an end face of said cable to be matably received by a complementary rearward contact section of said inner contact, the improvement comprising:

a retention sleeve insertable over said rearward section of said outer conductive shell from a rearward end thereof, said retention sleeve having a body section having an inner diameter incrementally smaller than an outer diameter of said rearward section of said outer conductive shell;

said retention sleeve including an inwardly directed annular flange at a rearward end thereof engageable with said rearward end of said rearward section of said outer conductive shell;

said rearward section of said outer conductive shell including a cable-receiving bore extending thereinto from said rearward end, said cable-receiving bore and said inwardly directed annular flange of said retention sleeve having respective inner diameters just larger than the outer diameter of said semirigid outer conductor of said cable;

said cable-receiving bore including an annular recess formed thereinto from said rearward end, and an annular preform of solder being disposed in said annular recess and held therein by said inwardly directed annular flange of said retention sleeve, whereby said connector includes a preform of solder contained therein enabling the outer conductive shell of the connector to be soldered to the semirigid outer conductor of the cable.

5. An improved coaxial connector of the type having an outer conductive shell in which is contained a dielectric sleeve containing an inner contact, and having a rearward end adapted to be terminated to an end of a coaxial cable having a semirigid outer conductor around an insulative jacket containing an inner conductor having an end section extending forwardly from the cable end to be matably received by a complementary rearward contact section of said inner contact, the improvement comprising:

a retention sleeve insertable over said rearward section of said outer conductive shell from a rearward end thereof, said retention sleeve having a body section having an inner diameter incrementally smaller than an outer diameter of said rearward section of said outer conductive shell;

said retention sleeve including an inwardly directed annular flange at a rearward end thereof engageable with said rearward end of said rearward section of said outer conductive shell;

said rearward section of said outer conductive shell including a cable-receiving bore extending thereinto from said rearward end, said cable-receiving bore and said inwardly directed annular flange of said retention sleeve having respective inner diameters just larger than the outer diameter of said semirigid outer conductor of said cable;

said cable-receiving bore including an annular recess formed thereinto from said rearward end;

an annular preform of solder being disposed in said annular recess and held therein by said inwardly directed annular flange of said retention sleeve; and said body section of said retention sleeve comprising a first layer of a first metal having low electrical resistance and low magnetic permeability and having defined on the outwardly facing surface thereof a second layer of a second metal having high electrical resistance and high magnetic permeability intimately joined to said first layer, whereby said connector includes a preform of solder contained therein and defining a self-regulating temperature source adapted to reflow the solder preform upon being subjected to constant amplitude high frequency alternating current, forming a solder joint between said semirigid outer conductor and at least one of said retention sleeve and said outer conductive shell, enabling the outer conductive shell of the connector to be electrically joined to the semirigid outer conductor of the cable.

6. An improved coaxial connector as set forth in claim 5 wherein said retention sleeve body section is formed from beryllium copper alloy and said second layer is an alloy of forty-two percent nickel and fifty-eight percent iron and has a thickness of between 0.0010 and 0.0020 inches, and said solder preform has a reflow temperature of 183° C.

* * * * *